United States Patent [19]

Johnson et al.

[11] Patent Number: 4,867,607

[45] Date of Patent: Sep. 19, 1989

[54] LINKAGE APPARATUS HAVING A MECHANISM FOR DAMPENING VIBRATIONS

[75] Inventors: Robert M. Johnson, South Haven; Ralph V. Johnson, Princeton, both of Minn.

[73] Assignee: R. M. Johnson Company, Annandale, Minn.

[21] Appl. No.: 61,194

[22] Filed: Jun. 11, 1987

[51] Int. Cl.[4] ..... A01B 3/64; E02F 5/10

[52] U.S. Cl. ..... 405/182; 172/40; 405/180

[58] Field of Search ..... 405/154, 174, 180, 182, 405/183; 37/193; 172/40, 699

[56] References Cited

U.S. PATENT DOCUMENTS

| | | | |
|---|---|---|---|
| 3,363,423 | 1/1968 | Davis . | |
| 3,406,525 | 10/1968 | Kinnan . | |
| 3,502,152 | 3/1970 | Johnson | 405/182 X |
| 3,561,539 | 2/1971 | Evans . | |
| 3,575,006 | 4/1971 | Rugroden . | |
| 3,618,237 | 11/1971 | Davis . | |
| 3,684,030 | 8/1972 | Lucero . | |
| 3,685,591 | 8/1972 | Ulrich et al. . | |
| 3,757,869 | 9/1973 | Gagne . | |
| 3,777,500 | 12/1973 | Kelley . | |
| 3,935,712 | 2/1976 | Erickson et al. | 405/182 |
| 4,038,828 | 8/1977 | Schuck et al. . | |
| 4,040,261 | 8/1977 | Schuck et al. . | |
| 4,119,157 | 10/1978 | Schuck et al. . | |
| 4,164,982 | 8/1979 | Draney . | |
| 4,200,410 | 4/1980 | Baker et al. . | |
| 4,397,585 | 8/1983 | Fouss et al. . | |
| 4,463,509 | 8/1984 | Leonard . | |
| 4,629,363 | 12/1986 | Rose et al. . | |
| 4,637,755 | 1/1987 | Tollefson et al. . | |

*Primary Examiner*—David H. Corbin

*Attorney, Agent, or Firm*—Merchant, Gould, Smith, Edell, Welter & Schmidt

[57] ABSTRACT

Linkage apparatus for connecting a use device, preferably a vibrating cable plow, to a ground-engaging vehicle. The linkage apparatus comprises a first arm member having a first mechanism for connecting the first end to the vehicle, a second arm member having a second mechanism for connecting the second end to the use device, a third mechanism for pivotally connecting the first and second arm members, and a mechanism for dampening vibrations between the first and second arm members perferably including resilient members such as air cushion bags.

26 Claims, 6 Drawing Sheets

LINKAGE APPARATUS HAVING A MECHANISM FOR DAMPENING VIBRATIONS

FIELD OF THE INVENTION

The present invention relates to a linkage apparatus for connecting a use device, most preferably a vibrating cable plow apparatus, to a ground-engaging vehicle, wherein the linkage apparatus includes a mechanism for dampening vibrations.

BACKGROUND OF THE INVENTION

Cable plows of the type disclosed herein have been utilized for many years to lay many types of cables, flexible pipes, conduits, etc. The cable or pipe has been passed into a trench, dug by a plow-blade, through a chute, or some other mechanism for guiding the cable or pipe, which trails the leading edge of the plow-blade. In either case, the cable generally passes into an opening in the ground created by the blade from a spool mounted on the vehicle which pulls the plow apparatus. Because the plow must be pulled through very rough and, at times, heavily packed terrain, the ground-engaging vehicle which pulls the plow apparatus has had to be a very large and powerful tractor.

Vehicles pulling cable plows have generally been required to travel at relatively slow speeds, laying cable at a rate in a range of inches per minute. In this regard, it has been found that vibration, or reciprocating movement of the plow-blade, is effective to work the soil and reduce the tractive pulling force required to pull the blade through the ground. Where such vibration or reciprocating movement of the blade was employed, it was found that smaller tractors possessing less tractive pulling power could be used to lay cable. This ability to use smaller tractors offered several advantages including less ground disturbance, more maneuverability, faster cable laying, greater mobility, etc.

Following the development of vibratory cabling laying plows, however, it became apparent that the vibrations from the plow had a negative effect on the operators of such machinery, and upon the working parts of the vehicle pulling the plow. It proved to be very stressful for operators to be subjected to constant vibrations for long periods of time each day. In addition, the parts of the vehicle tended to come apart and need repeated tightening. The vehicles also seem to wear faster.

Therefore, efforts were made to dampen the vibrations emanating from the plow apparatus. For example, U.S. Pat. No. 3,618,237 discloses a frame support for a cable laying plow apparatus having torque cushioning elements which absorb some of the reciprocable motion of the support in an attempt to isolate the frame from the supporting structure. A four-point support apparatus is also provided to cooperate to define a parallelogram-type linkage apparatus.

U.S. Pat. No. 3,561,539 discloses a vibratory cable plow having a sharpened plow point at an unspecified angle and a plurality of resilient pads designed to enhance vibratory movement and dampen the transfer of vibratory movement from the enlongated plowblade to the mounting frame. Unfortunately, none of these dampening means adequately dampens vibrations from the vibration or reciprocating device.

The vibratory plow apparatus of U.S. Pat. No. 3,561,539 also discloses a parallelogram-type apparatus for raising and lowering the plow while maintaining the plow-blade in a substantially vertical orientation. U.S. Pat. No. 3,684,030 also discloses a parallelogram-type support structure for a plow-blade including a number of digger teeth which project forwardly and downwardly from the plow-blade. Motive mechanisms are also disclosed for swinging the linkage mechanism on a vertical axis with respect to the vehicle, and for lifting the lower arm of the linkage mechanism and hence the plow-blade.

One of the advantages of the parallelogram-type linkage mechanism is that the plow may be raised without changing the vertical orientation of the plow to the soil. As compared to three point linkage mechanisms, this enables the cable plow to continue laying cable at the lowest possible depth when the plow must be raised to traverse over immovable objects such as pipes or large rocks which may be buried in the soil. When a three point lift mechanism is employed, the plow is generally raised such that the plow is angled backwards and away from the vehicle. The backside of the plow-blade where the cable guide outlet mechanism is generally located, is thereby raised to a greater degree than the leading edge of the plow-blade which must traverse across the buried object. Since the backside of the plow-blade angles upward from the leading edge of the plow-blade, the cable can come out of the guide mechanism as much as a foot higher than the leading edge of the plow-blade. The parallelogram-type linkage mechanism allows the plow to be raised vertically without creating this angle, thereby allowing the cable to be laid at the greatest depth possible when traversing over immovable buried objects.

One disadvantage of the parallelogram-type linkage mechanism is that although it enables one to lay cable at the lowest depth possible when traversing over immovable buried objects, it is not possible to maintain the blade at a desired orientation to the ground when traveling through irregular terrain. In irregular terrain, when the vehicle and the plow-blade may simultaneously engage ground at different pitches or slopes, the angle of the plow-blade will depend on the slope of the ground to which the vehicle is engaged. This slope may be entirely different from the slope of the ground in which the plow-blade is engaged. In such a situation, the plow-blade will not be perpendicular to the ground. This can result in the backside of the plow-blade being at a different depth than the leading edge of the plow-blade. If the backside is higher than the leading edge, the cable emerging from the backside can be laid at inconsistent depths in irregular terrain.

It will be appreciated from the foregoing that prior art devices present problems which are in need of solutions. The present invention provides solutions for these and other problems.

SUMMARY OF THE INVENTION

The present invention is directed to a linkage apparatus for connecting a use device, most preferably a vibrating cable laying plow apparatus, to a ground-engaging vehicle. The linkage apparatus includes: a first arm member having first and second ends and a first mechanism for connecting the first end to the vehicle; a second arm member having first and second ends and a second mechanism for connecting the second end to the use device; a third mechanism for pivotally connecting the first and second arm members; and a mechanism for dampening vibrations between the first and second arm members. The dampening mechanism preferably includes a resilient member which dampens vibrations, preferably an air cushion bag. More preferably, the dampening mechanism includes a resilient member on each side of the third pivotal connecting mechanism. The third pivotal connecting mechanism preferably includes a substantially horizontal axis about which the first and second arm members pivot. More preferably, the linkage apparatus also includes an upper mechanism for linking the use device to the vehicle which is located above the first and second arm members and has first and second ends. The linkage apparatus preferably includes a fourth mechanism for pivotally connecting the first end of the upper linking mechanism to the vehicle, and a fifth mechanism for pivotally connecting the second end of the upper linking mechanism to the use device. The first connecting mechanism and the second connecting mechanism are preferably mechanisms for pivotally connecting. The upper linking mechanism, preferably cooperates with the first and second arm members to substantially form a four point linkage having four pivotal connection points in a roughly quadralateral orientation, and a fifth pivotal connection linking the first and second arms.

Preferably, the invention includes a mechanism for lifting the first arm member wherein the pivotal connecting mechanisms of the first and second ends of the upper linking mechanism, the first end of the first arm member, and the second end of the second arm member, have substantially horizontal axes such that when the first arm member is lifted, the first arm member and the upper linking mechanism pivot substantially horizontally about their first end pivotal connecting mechanisms. The upper linking mechanism preferably includes an upper linkage member and a mechanism for adjusting the length of the upper linkage member, such that the angle of alignment of the use device may be adjusted by adjusting the length of the upper linkage member.

The present invention offers many advantages over the prior art, some of which are discussed below. The arrangement of the first and second arm members, the third pivotal connecting mechanism and the dampening mechanism allow the use of larger vibrating units which will direct more vibration to the use device, while minimizing the vibrations transferred from the use device to the vehicle. During operation, the vibrating cable plow of the present invention directs most of the force, or torque, created by the ground as it resists the plow-blade which is being pulled through the ground, to the second connecting mechanism between the lower linking mechanism and the plow-blade. This is because this mechanism is the closest pivot point with respect to the force vector which resists movement of the lower end of the plow-blade through the ground. Because the bulk of the force resisting the tractive pulling force of the vehicle is therefore directed to the second connecting mechanism, the bulk of the vibrations from the plow-blade are directed along the lower linking mechanism, and particularly, along the second arm member which is pivotally attached to the first arm member. Rather than transferring the vibrations to the vehicle, however, the bulk of the vibrations along the lower linking mechanism are directed to the dampening mechanism interposed between elements of the first and second arm members.

The pivotal movement of the first and second arm members with respect to one another, cooperate with the pulling force exerted on the plow-blade, the pivotal connecting mechanisms which allow other pivotal movement, and the tooth of the plow-blade, to urge the lower end portion of the plow-blade, specifically the tooth of the plow-blade, to follow an elliptical path. The upper surface of the tooth, and particularly the specific angle of the upper surface of the tooth with respect to a line perpendicular to the front edge of the plow-blade, blade, is very important in creating this pattern of elliptical movement. The elements described above cooperate to effectively utilize the tractive pulling force of the vehicle and the vibratory energy directed along the lower linking mechanism to provide the elliptical motion of the tooth which works the ground, thereby making it easier to pull the plow-blade.

The cycle of elliptical motion starts with the first and second arm members in a substantially parallel relationship such that the straight line length is maximized between the distal ends of the lower linking mechanism, meaning the first end of the first arm member and the second end of the second arm member where the first and second connecting mechanisms are respectively located. When the arm members pivot such that the distance between their distal ends is shortened, since the radius of the pivot about the third connecting mechanism is shorter than the radius of the pivot about the fourth connecting mechanism, the lower end of the plow-blade is drawn closer to the vehicle. At the same time as the lower end is drawn closer, the angle of the upper surface of the tooth meets the ground at such an angle that it acts to force the plow-blade initially downward. The movement of the lower end of the plow-blade is, therefore, initially downward and toward the vehicle. As the plow-blade pivots, and as the angle of the surface of the tooth changes with respect to the vector of the tractive pulling force being exerted on the plow-blade, the lower end of the plow-blade and the tooth gradually turn upward and the tooth passes through the bottom of its elliptical cycle, and comes to the top of the pattern. Throughout that pattern of movement, the tooth works the ground. Once the angle of the surface of the tooth no longer forces the plow-blade downward, the distance between the distal ends of the two arm members begin to lengthen. As this distance lengthens, the angle of the plow-blade and the angle of the surface of the tooth with respect to the vector of the pulling force being exerted on the plow-blade change, returning to the original angles. When the angles return to the original angles, and when the length between the ends of the lower linking mechanism is maximized, the tooth pulls the blade downward again and the distance between the distal ends of the two arm members shortens again, and the elliptical cycle begins a second path downward and toward the vehicle. It is this elliptical pattern of movement which works the soil and reduces the requirement for tractive pulling force. For this reason, the present invention requires much less tractive pulling power than the prior art devices, and therefore, does not require tractors as large as those generally used with the prior art devices. It is understood that other patterns of motion are possible with other configurations of the elements discussed herein.

A further advantage of the present invention is the mechanism for adjusting the length of the upper linking member which allows the angle of the plow-blade with respect to the ground to be adjusted when the plow-blade is traversing irregular terrain. The ability to manipulate the angle of the plow-blade with respect to the ground allows the operator to go over a ridge and through a ditch while at the same time maintaining the plow-blade at a perpendicular angle to the ground. This allows the operator to prevent the rear part of the lower end of the plow-blade, where the cable guide means generally release the cable into the ground, from angling toward the surface with respect to the position of the front edge of the lower end of the plow-blade. This manipulation allows operators to lay all the cable, even that laid in irregular terrain, at a consistent depth.

The above described features and advantages along with various other advantages and features of novelty are pointed out with particularity in the claims of the present application. However, for a better understanding of the invention, its advantages, and objects attained by its use, reference should be made to the drawings which form a further part hereof and to the accompanying descriptive matter in which preferred embodiments of the invention are described and illustrated.

DETAILED DESCRIPTION OF THE PREFERRED EMBODIMENT OF THE INVENTION

Figure 1:
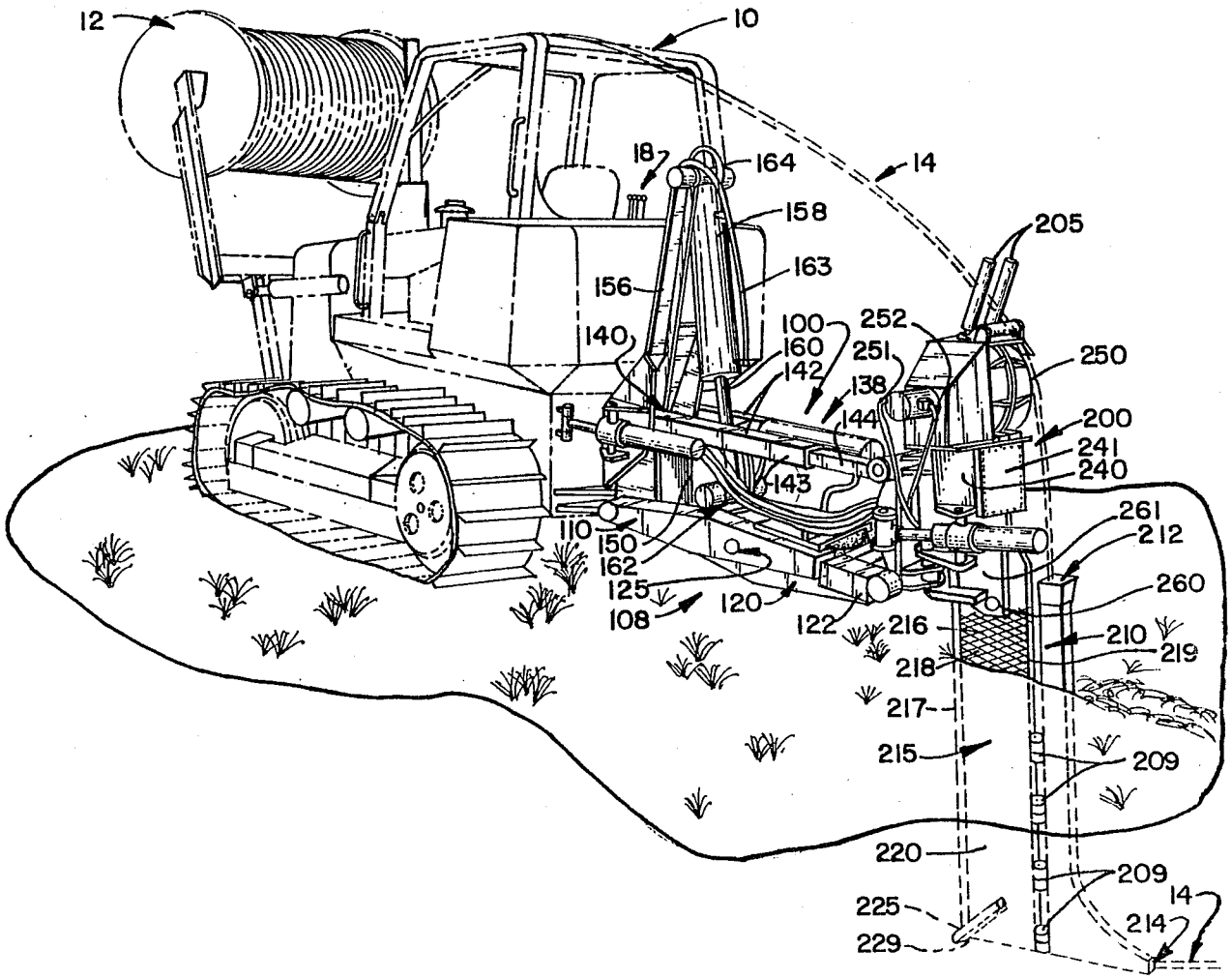
FIG. 1 is an elevational perspective view of the linkage apparatus of the present invention connecting a cable plow apparatus to a ground-engaging vehicle and shown in its environment pulling the plow through the ground.

Referring to the drawings, FIG. 1 shows a preferred embodiment of a linkage apparatus 100 for connecting a use device, preferably a vibrating cable plow apparatus 200 as shown, to a ground-engaging vehicle, preferably a tractor 10. The tractor 10 can carry a large spool 12 from which a continuous cable 14 is dispensed. The cable 14 passes between two cable guide posts 205, into a cable guide chute 210 having a cable entrance 212 and a cable outlet 214.

The use device of the present invention may be any apparatus which causes vibrations. It may be any ground working device including a plow, preferably a cable plow, and most preferably a vibrating cable plow for laying cable in the ground or subsurface.

The ground-engaging vehicle of the present invention can be a tractor of virtually any size having any type of traction devices. Since the preferred embodiment of the present invention is capable of dampening vibrations from a very large vibrator, thereby allowing the cable plow to use a large vibrator, the tractor may be much smaller and provide much less tractive pulling force than would otherwise be required for laying cable in occasionally heavily packed ground. For this reason, the tractor may have wheels, preferably rubber wheels which might not otherwise provide the required tractive pulling power to pull a cable plow through heavily packed ground.

Embodiments of the present invention may lay many types of cable, flexible pipe, conduit, tubing, and the like. Electrical cable is commonly laid by such a device. Recently, devices which can lay cable without jarring the cable have been needed to lay fiber-optic cable which has small fiberglass filaments in the center of a heavily insulated cable. Any violent shaking or pounding of the fiber-optic cable may damage it such that it is less effective in carrying transmissions. Therefore, a device which minimizes any violent concussion of the cable would be a desirable apparatus for use in connection with laying such a cable.

Figure 2:
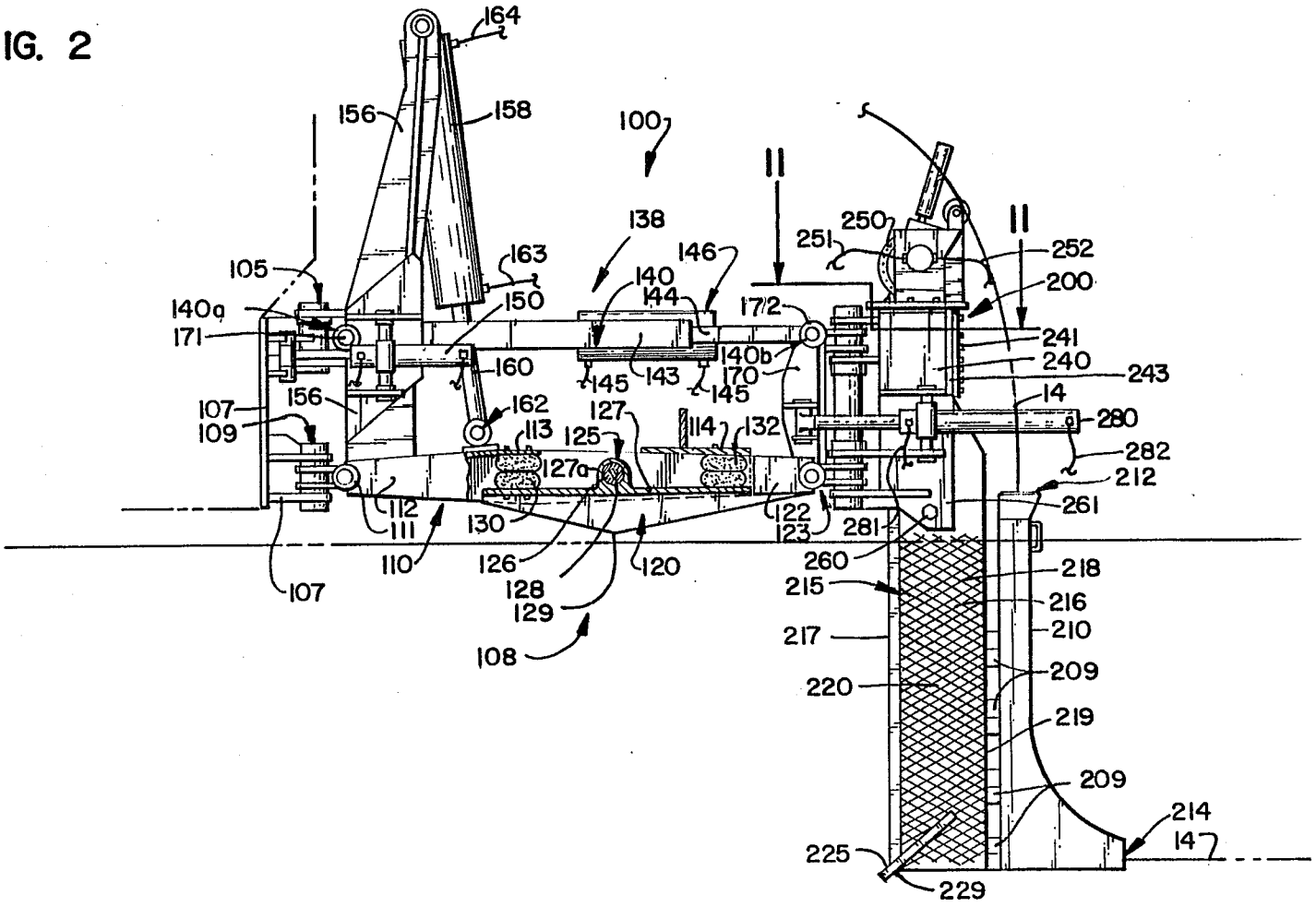
FIG. 2 is a side view of the linkage apparatus of the present invention connected to a cable plow apparatus, wherein the lower linking mechanism is shown in partial cross section.
Figure 3:
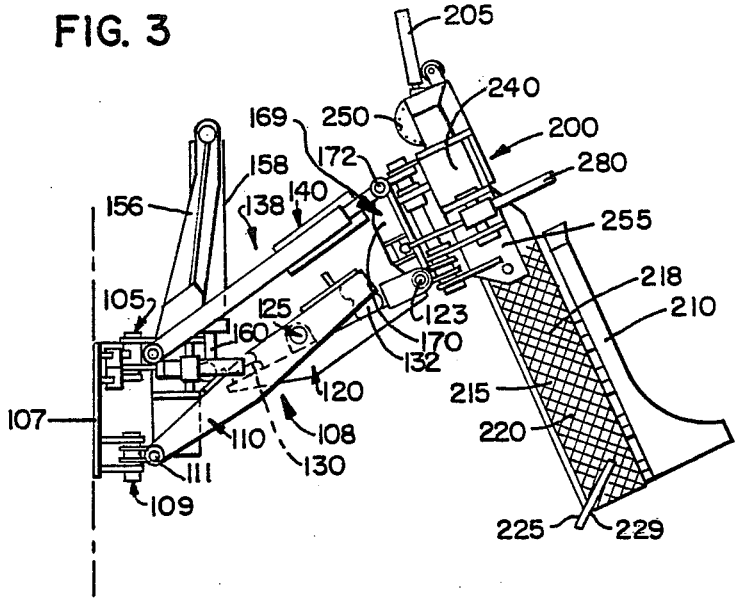
FIG. 3 is a side view similar to FIG. 2 wherein the first arm has been raised.
Figure 4:
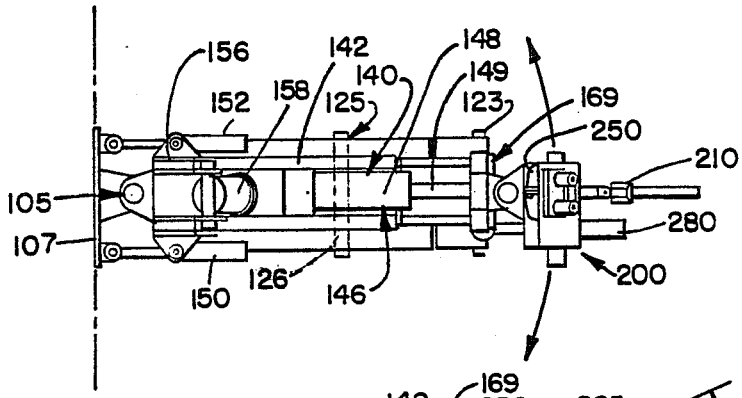
FIG. 4 is a top view of the linkage apparatus connected to a vibrating cable plow apparatus.
Figure 5:
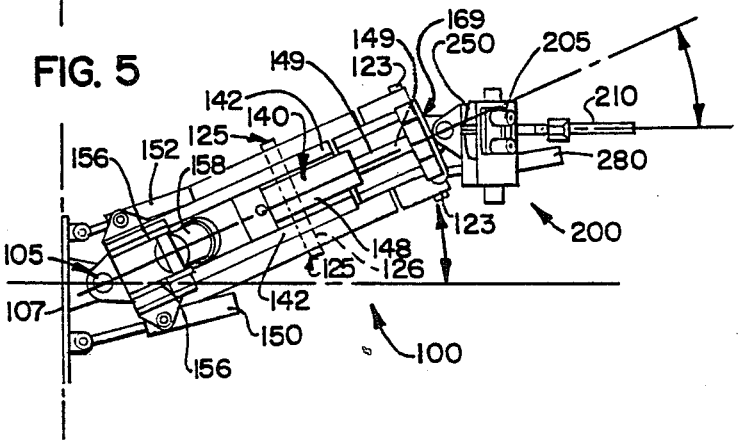
FIG. 5 is a top view similar to FIG. 4 wherein the linkage apparatus is swung to one side of the vehicle and the plow-blade is angled in the opposite direction with respect to the linkage apparatus.

Referring now to FIGS. 1 and 2, the linkage apparatus 100 in accordance with principals of the present invention, has an upper linkage mechanism 138 and a lower linkage mechanism 108 which are pivotally connected such that the linkage apparatus 100 has a four-point linkage. The upper linkage mechanism 138 includes an upper linking member 140 which includes two parallel upper linking arm members 142 which are adjustable in length. Each upper linking arm member 142 includes a sleeve 143 and a sliding arm 144 which slides inside of the sleeve 143 to allow adjustment in length of the upper arm members 142. The upper linking mechanism 138 also includes a hydraulic cylinder 146. Referring also to FIG. 3, 4 and 5, the hydraulic cylinder 146 is located between the upper arm members 142 and is connected thereto. The hydraulic cylinder 146 includes a sleeve 148 and a piston 149 in a typical hydraulic cylinder, sleeve and piston arrangement. Hydraulic cable lines 145 are connected to a hydraulic control mechanism 18 in the vehicle 10 which supplies hydraulic power to drive the cylinder 146 in a conventional fashion known to those of skill in the art. The upper linking arm member 142 and the piston 149 are pivotally connected to an outer support member 170. At the opposite end the upper linking arm members 142 are pivotally connected to a vertical support member 156.

Figure 6:
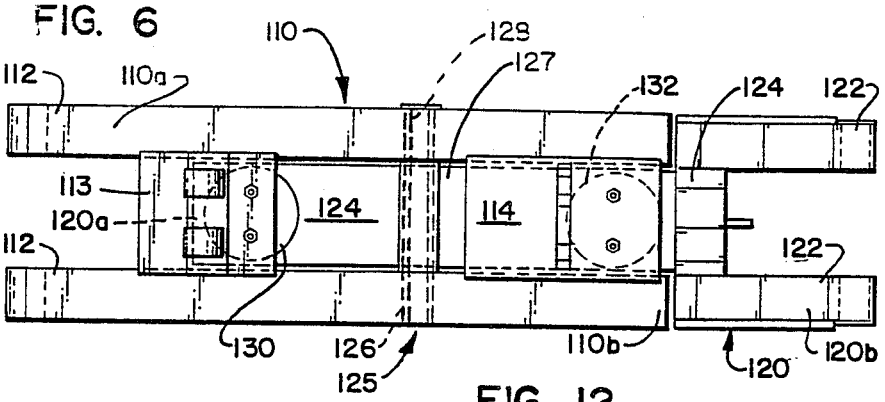
FIG. 6 is a top view of the lower linking mechanism showing a pivotal connection between the first and second arms and air cushion bags in phantom.

The lower linking mechanism 108 includes a first arm member 110 and a second arm member 120 which are pivotally connected. The distal ends of the lower linking mechanism, away from the pivotal connection 125 which joins the arm members 100 and 120, are pivotally connected to a vertical support member 156 and an outer linking mechanism 170. The first and second arm members 110 and 120 are pivotally connected about a pivotal connection 125, including bushings 126 in the first and second arm members 110 and 120, and a pin 128 forming a substantially horizontal axis. Still referring to FIGS. 1-5, along with FIG. 6, the first arm member 110 includes two parallel support members 112 which are connected by a first plate member 113 and a second plate member 114 which are connected to the parallel support members 112. A first end 110*a* of the first arm member 110 is pivotally connected to the vertical support member 156. A pin 111 forming a horizontal axis passes through the first end 110*a* of the first arm member 110, thereby passing through both of the parallel support members 112.

The second end 120*b* of the second arm member 120 also has a pivotal connection 123. The second end 120*b* of the second arm member 120 is preferably bifurcated into two second arm end members 122 which are joined to a second arm body member 124 which is connected to the second arm end members 122 to form a single integral second arm member 120. The second arm body member 124 is a flat metal, preferably steel alloy, body plate 127 supported by a number of horizontal beams 129. The body plate 127 is substantially horizontal and is supported by four horizontal beams 129 which are connected to the bottom surface of the body plate 127 and oriented perpendicularly to the plane of the body plate 127. Bushings 126 extend through a receiving portion 127*a* and receive the pin 128 which forms an axis about which the second arm member 120 pivots in relation to the first arm member 110. The pin 128 passes through the bushings 126 and the first arm member 110 to pivotally connect the first and second arm members 110 and 120 about the pivotal connection 125.

Interposed between the first plate member 113 and the second plate member 114 of the first arm member 110 and the body plate 127 of the second arm body member 124 of the second arm member 120, are air cushion bags 130 and 132. These air cushion bags 130 and 132 are attached, preferably using fasteners, preferably bolts, to the first and second plate members, 113 and 114 respectively, of the first arm member 110 and to the body plate 127 of the second arm body member 124. Additional air cushion bags can be added, but are not necessary.

The mechanism for dampening vibrations between the first and second arm members may include any mechanism for cushioning an impact. Resilient members of the present invention may include hydraulic cushioning mechanisms, gas cushioning mechanisms such as gas pack struts or shock absorbers, resilient springs of various types, including metal coils and other metal spring devices generally known in the art, hard or soft rubber or polymer cushions or pucks, or the air cushion bags of the preferred embodiment. The air cushion bags are similar to air bags used to cushion semi-truck trailers. These air bags are used in the place of struts or shock absorbers and accomplish the same task. Such air bags are generally made of vulcanized rubber or other materials similar to the materials used to construct rubber road tires. The air cushion bags may have intertubes or may be tubeless. Preferably, they hold air and the air may be increased or decreased using appropriate mechanism. During operation, the air cushion bags 130 and 132 cushion, or absorb, the vibrations between the first and second arm members 110 and 120, thereby dampening the vibrations and reducing the transfer of vibrations to the vehicle.

The first end 110*a* of the first arm member 110 is pivotally connected to vertical support member 156 which is pivotally connected to vehicle frame 107. The first end 140*a* of the upper linking mechanism 140 is also pivotally connected to the vertical support member 156 which is pivotally connected to the vehicle frame 107. The pivotal connections 105 and 109 between the vertical support member 156 and the frame 107 have substantially vertical axes which allow the linkage apparatus 100 to swing horizontally left and right with respect to the vehicle. In the preferred embodiment, this motion is driven by hydraulic cylinders 150 and 152 located on either side of the linkage apparatus 100 and pivotally connected to the frame 107 and the vertical support member 156.

The vertical support member 156 is pivotally connected to a substantially upright hydraulic cylinder 158. The hydraulic cylinder 158 has a typical hydraulic cylinder, piston and sleeve arrangement. The piston 160 is pivotally connected to the first arm member 110 at a pivotal connection point 162. All of the hydraulic cylinders are linked to a hydraulic control mechanism 18 in the vehicle 10, the upright cylinder 158 being so linked by hydraulic cables 163 and 164.

Figure 7:
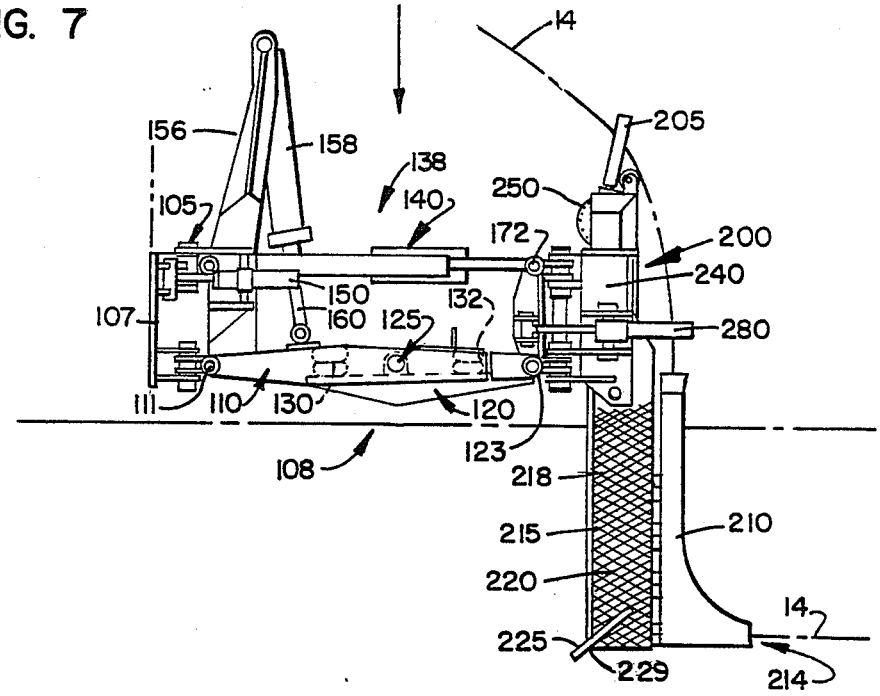
FIG. 7 is a side view of the linkage apparatus connected to a cable plow apparatus, wherein the length of the upper linking mechanism is substantially the same as the length of the lower linking mechanism.
Figure 8:
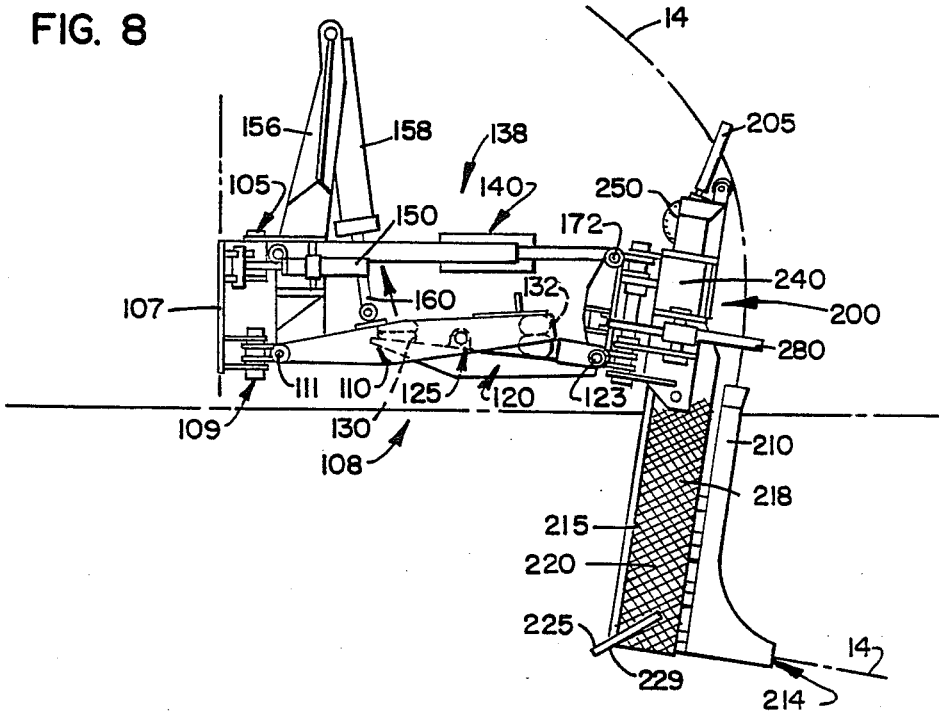
FIG. 8 is a side view similar to FIG. 7 wherein the distance between the first end of the first arm and the second end of the second arm is shortened.

When the first arm member 110 is lifted by the hydraulic cylinder 158, the first arm member 110 pivots with respect to the second arm member 120 on the horizontal axis of the pivotal connection 125, as well as with respect to the vertical support member 156. Referring also to FIG. 7 and 8, if the pivotal connection 125 lies on a straight line between the pivotal connections 111 and 123 of the first end 110*a* of the first arm member 110 and the second end 120*b* of the second arm member 120 when the first arm member 110 is lifted by the hydraulic cylinder 158, then, when the first arm member 110 pivots with respect to the second arm member 120 on the horizontal axis of the pivotal connection 125, the pivotal connection 111 will be drawn closer to the pivotal connection 123. In addition, when the second arm member pivots on the horizontal axis of the pivotal connection 125, the lower end 220 of the plow-blade 215 will be drawn closer to the vehicle 10. This is because the second arm member 120 will pivot on a shorter radius than the upper linking member 140 pivots, thereby drawing the lower end 220 of the plow-blade 215 closer to the vehicle 10.

The outer linking mechanism 169 includes an outer support member 170 which is pivotally connected to the second arm member 120 at the pivotal connection 123 located at the second end 120*b* of the second arm member 120. The outer support member 170 is also pivotally connected to the upper linking mechanism 140 at a pivotal connection 172 at the second end 140*b* of the upper linking mechanism 140.

Figure 9:
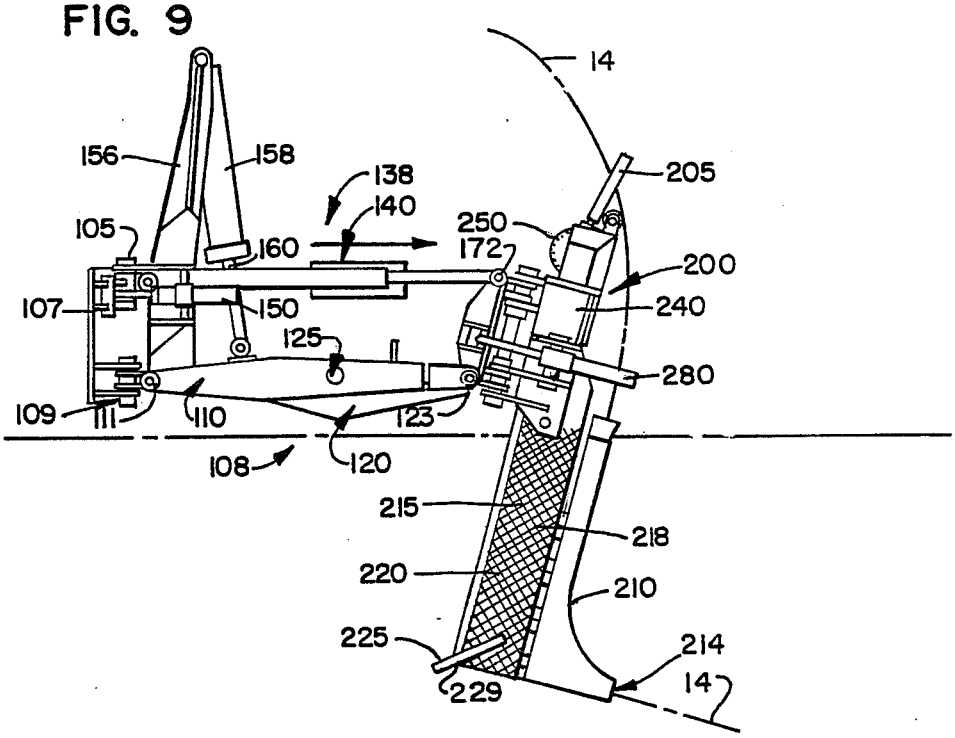
FIG. 9 is a side view similar to FIG. 7 wherein the upper linking mechanism is longer.
Figure 10:
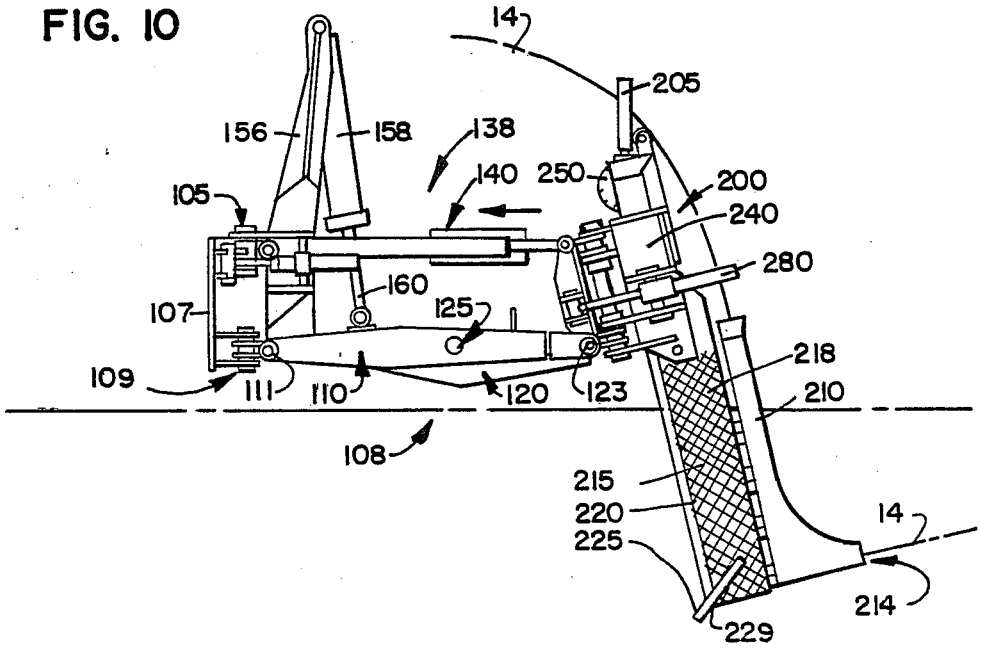
FIG. 10 is a side view similar to FIG. 7 wherein the length of the upper linking mechanism is shorter.

Referring also to FIG. 9 and 10, the linkage apparatus of the preferred embodiment of the present invention forms a four-point linkage which exists as a parallelogram-type linkage when the upper linking mechanism 138 has the same length as the lower linking mechanism 108. Since the upper linking mechanism 138 includes a mechanism for adjusting the length of the upper linking member 142, and since the straight line length of the lower linkage mechanism 108 may also be varied, the four-point linkage of the present invention need not exist at all times as a parallelogram-type linkage. The upper linking member 142 may be shortened or lengthened with respect to the lower linking mechanism 108 thereby changing the angle of the plow-blade 215 with respect to the linkage apparatus 160 and the vehicle 10. Such adjustments of the upper linking mechanism 138, may be used to vary the angle of the plow-blade 215 with respect to the ground, thereby obtaining a desired angle with respect to the ground when the plow-blade 215 traverses through irregular terrain.

Figure 11:
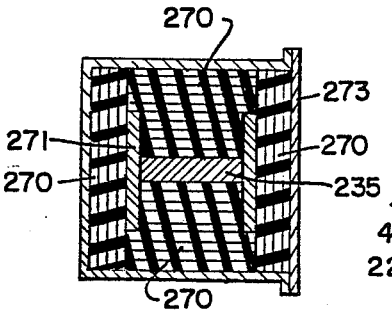
FIG. 11 is a cross-sectional view through line 11—11 of FIG. 2.

The plow apparatus of the present invention includes a plow-blade housing 200 having a mechanism for receiving an upper end 235 of the plow-blade 215, wherein the housing 200 is pivotally attached to the outer support member 170. The housing 200 includes a bolt 260, which passes through an opening in the plow-blade 215, and through openings in two vertical plates 261 which extend identically down and along both sides of the upper portion 235 of the plow-blade 215, such that the bolt 260 will pass through the openings in the vertical plates 261 of the housing 200 and the opening in the plow-blade 215 to connect to the plow-blade 215 to the housing 200. The receiving mechanism includes a box 240 receiving the upper end 235 of the plow-blade 215. The box 240 is connected to vibration mechanism, preferably an eccentric hydraulic vibrator 250. The hydraulic vibrator 250 is connected to a hydraulic control mechanism 18 by hydraulic cables 251 and 252 and is controlled in a conventional fashion as known to those skilled in the art. Any vibrating mechanism generally known in the art may be used with the cable laying plow apparatus of the present invention. Referring also to FIG. 11, the box 240 includes rubber strips 270 and metal strips 271 and 273 which are packed around the plow-blade 215 such that the movement of the upper end 235 of the plow-blade 215 is restricted to movement within the box 240.

Figure 12:
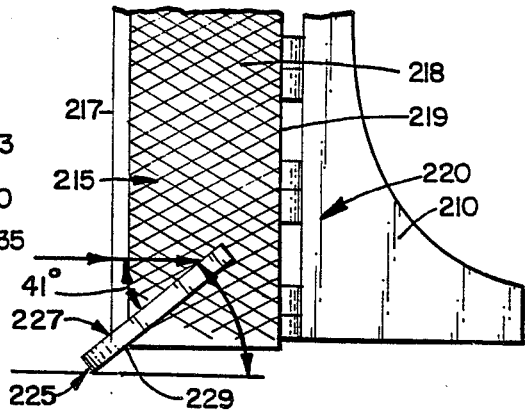
FIG. 12 is a side view of the lower portion of the cable plow.
Figure 13:
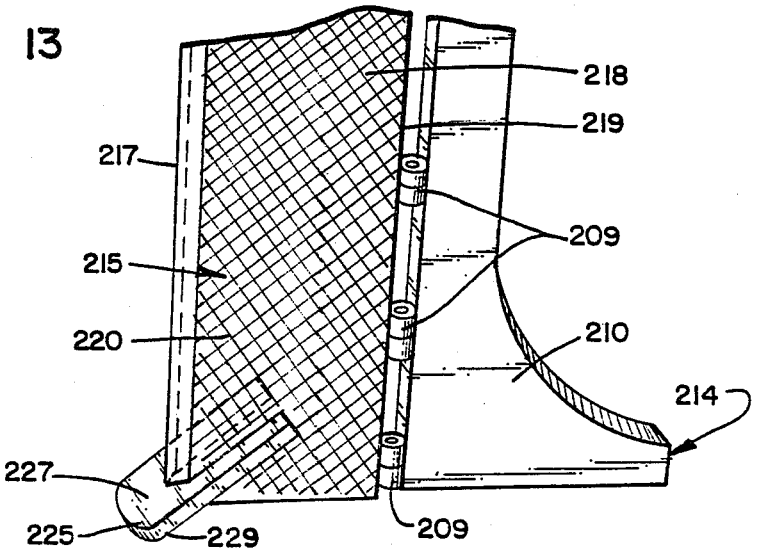
FIG. 13 is a perspective view of the lower portion of the cable plow showing the upper surface of the tooth and the edge of the plow-blade.

Referring also to FIG. 12 and 13, the plow-blade 215 has a front edge 217, two vertically extending side surfaces 216 and a tooth 225. The tooth 225 extends downwardly and outwardly from the front edge 217, and outwardly from the side surfaces 216 of the plow-blade 215. Preferably, the upper surface 227 of the tooth 215 is aligned at an angle of about 37°–43° with respect to a line which is perpendicular to the front edge 217 of the plow-blade 215.

The plow-blade preferably has a single opening through which a pin, preferably the bolt 260 is inserted to hold the plow-blade in place with respect to the housing 200. The bolt 260 passes through openings in two vertical plates 261 which extend identically down and along on both sides 216 of the plow-blade 215. The plow-blade 215 is substantially prevented from pivoting on bolt 260 by the box 240 receiving the upper end 235 of the plow-blade 215. The upper end of the plow-blade 235 is tapered or truncated to fit into a slot in the bottom of the box 240. The plow-blade 215 does not come into direct contact with any portion of the box 240. The upper end 235 of the plow-blade 215 received by the box 240 is packed in a series of rubber strips 270 which cooperate with two metal strips 271 and 273 which cooperate to prevent substantial movement of the upper end 235 of the plow-blade 215 in the box 240. The metal plates 271 and 273 do not come into contact with the box 240, but instead, only with the rubber strips 270. In other embodiments, the rubber strips 270 may be made of any resilient material known in the art. It is possible to interpose resilient material or packings between the upper portion 235 of the plow-blade 215 and the metal strips 271 and 273. The metal strips 271 and 273 prevent the plow-blade from damaging the rubber strips 270. The box also has a plate 241 on one side which may be removed to access the rubber strips 270 and the metal strips 271 and 273. The plate 241 is attached to the box with fasteners, preferably bolts, which fasten the plate to a lip 243 on the edge of the adjacent side of the box 240.

The front edge 217 of the plow-blade 215 widens as it angles back to two parallel sides 216 on either side of the plow-blade 215. The sides of the plow-blade 216 have weldings 218 which form cross-hatchings to protect the plow-blade from wear. On the lower end 220 of the plow-blade 215, the tooth 225 extends downwardly and outwardly from the plow-blade 215 with respect to the front edge 217 of the plow-blade 215, and outwardly from the sides 216 of the plow-blade 215. The tooth 225 has an upper surface 227. The plane of the upper surface 227 of the tooth 225 lies at an angle of about 37°–43° with respect to a line which is perpendicular to the front edge 217 of the plow-blade 215. This edge 217 is a substantially straight line oriented vertically with respect to the plow-blade 215. The angle of the tooth is preferably about 38°–42°, more preferably about 39°–41°. The preferred embodiment has a tooth angle of about 41°.

The angle of the upper surface 227 of the tooth 225 with respect to the perpendicular line to the front edge 217 of the plow-blade 215 critical to minimize the amount of drag which is experienced when pulling the plow-blade through the soil. If the angle is too great, for instance more than 43°, the plow-blade 215 will have much greater resistance and will require much greater tractive pulling force. However, if the angle is too little, the eliptical motion of the tooth 225 during operation of the vibrator 250 and the tractor 10 will be minimized.

The upper surface 227 of the tooth 225 is also very important to the eliptical movement of the plow-blade 215, wherein the tooth 225 pulls the lower portion 220 of the plow-blade 215 downward as the lower portion 220 of the plow-blade 215 moves toward the tractor when the second arm member 120 pivots about the pivotal connection 125 to shorten the distance between the distal ends of the lower linking mechanism 108. 110. The tooth 225 prevents the plow-blade 215 from riding up because the tooth 225 must work the soil which meets the upper surface 227 of the tooth 225. It will be appreciated that other configurations with respect to the distance between the ends of the various linking mechanisms and members will vary the critical angle for optimum elliptical motion, and that other motions, therefore, will also be possible.

In the preferred embodiment, a cable guide chute 210 is pivotally attached to the rear edge 219 of the plow-blade 215. The rear edge 219 is flat having a plane which is roughly at right angles to the planes of the two vertical sides 216 of the plow-blade 215. The guide chute 210 has four pivotal connections 209 which pivotally connect the chute 210 to the plow-blade 215. The pivotal connections 209 allow the chute 210 to pivot with respect to the plow-blade 215 on a vertical axis. The chute 210 has a cable entrance 212 which receives the cable 14 and a cable outlet 214 which guides the cable 14 into an opening or a trench in the ground created by the plow-blade 215.

The housing 200 is pivotally connecting to the outer linking mechanism 169. This mechanism includes a hydraulic cylinder 280 having a typical hydraulic cylinder, piston and sleeve arrangement to pivot the plow-blade 215 with respect to the outer linking mechanism 169 and the linkage apparatus 100. The hydraulic cylinder 280 is pivotally connected to the housing 200 and pivotally connected to the outer linking support member 170. The hydraulic cylinder 280 is connected to the hydraulic control mechanism 18 by hydraulic cables 281 and 282. FIG. 5 presents a top view of a linkage apparatus 100 connected to a housing 200, wherein the linkage apparatus 100 is swung to one side with respect to the vehicle 10 and the plow-blade 215 and the housing 200 are swung in the opposite direction with respect to the outer linking mechanism 169 and the linkage apparatus 100.

FIG. 7 shows the four-point linkage of the linkage apparatus 100. The upper linking mechanism 138 is substantially equal in length to the lower linking mechanism 108, thereby allowing the four-point linkage to effect a parallelogram-type linkage. In FIG. 8, however, the first arm member 110 has been lifted by the hydraulic cylinder 158 such that the second arm member 120 has pivoted at the pivotal connection 125 with respect to the first arm member 110, thereby bringing the pivotal connection 111 of the first end 110*a* of the first arm member 110 closer to the pivotal connection 123 of the second end 120*b* of the second arm member 120, and thereby changing the configuration so that there is no longer a parallelogram-type linkage. The lifting of the first arm member 110 has drawn the lower portion 220 of the plow-blade 215 closer to the vehicle 10.

In FIG. 9, the length of the upper linking mechanism 138 has been adjusted such that the upper linking mechanism 138 is longer than the lower linking mechanism 108. The lower end 220 of the plow-blade 215 is drawn closer to the vehicle 10 as the upper linking mechanism 138 is lengthened. In FIG. 10, the length of the upper linking mechanism 138 has been adjusted so that the upper linking mechanism 138 is shorter than the lower linking mechanism 110. As the upper linking mechanism 138 is shortened, the lower end 220 of the plow-blade 215 is moved further away from the vehicle 10. Because the sleeve 143 is longer than the distance between the pivotal connections 125 and 123 of the second arm member 120, the radius of the pivot of the upper linking mechanism 138 will always be longer than the radius of the pivot of the second arm member 120 about the pivotal connection 125 which links the first and second arm members 110 and 120.

The adjustable length upper linking member 140, allows the plow-blade 215 to be maintained at a desireable angle with respect to the ground such that the cable outlet 214 is not angled backward and raised above the depth of a leading corner 229 of the plow-blade 215, as it would have to be at times when attached to prior art devices which do not have adjustable length upper linking members. The ability to manipulate the angle of the plow-blade 215 with respect to the ground surface allows the operator to go over a ridge and through a ditch, while at the same time maintaining the plow at a perpendicular angle to the surface. This allows the operator to prevent the cable outlet 214 at the back of the lower end 220 of the plow-blade 215, from angling toward the surface with respect to the position of the leading corner 229 of the lower end 220 of the plow-blade 215. This enables the operator to lay cable in irregular terrain while maintaining a substantially consistent cable depth. This is desireable since the cable may be damaged if it is exposed on the surface of the ground. The deeper the cable, the safer it is considered to be. This is especially true in ditches or gulleys which may be subject to erosion at later points in time, thereby increasing the likelihood that the cable may be exposed on the surface of the ground.

All of the hydraulic cylinders shown in the drawings of the preferred embodiment of the present invention are connected to a hydraulic control mechanism 18 in the vehicle 10 by hydraulic cables, some of which are bundled together in a cable bundle 162, which connects to the control mechanism 18. The hydraulic cylinders are controlled in conventional fashion as known to those skilled in the art.

While certain representative embodiments of the present invention have been described herein, for purposes of illustration, it will be apparent to those skilled in the art that modifications therein may be made without departing from the spirit and scope of the present invention.

What is claimed is:

1. Linkage apparatus for connecting a use device to a ground-engaging vehicle, the linkage apparatus comprising: a first arm member having first and second ends; first means for connecting the first end to the vehicle; a second arm member having first and second ends; second means for connecting the second end of the second arm to the use device; third means for pivotally connecting the first and second arm members, upper means for linking the use device to the vehicle, said upper linking means being located above the first and second arm members and having first and second ends; and means for dampening vibrations between the first and second arm members, said dampening means including a resilient member interposed between the first and second arm members.

2. The linkage apparatus of claim 1 wherein the dampening means includes a resilient member which dampens vibrations between the first and second arm members.

3. The linkage apparatus of claim 2 wherein the resilient member is an air cushion bag.

4. The linkage apparatus of claim 1 wherein said dampening means includes a resilient member located on each side of said third pivotal connecting means.

5. The linkage apparatus of claim I wherein the third pivotal connecting means includes a substantially horizontal axis about which the first and second arm members pivot.

6. The linkage apparatus of claim I including fourth means for pivotally connecting the first end of said upper linking means to the vehicle and fifth means for pivotally connecting the second end of said upper linking means to the use device, said first connecting means having means for pivoting said first end of said first arm member with respect to the vehicle, and said second connecting means having means for pivoting said second end of said second member with respect to the use device, wherein a four point linkage mechanism having four pivotal connection linkage points in a roughly quadralateral orientation and a fifth pivotal connection linking the first and second arms is formed.

7. The linkage apparatus of claim 6 including means for lifting the first arm member.

8. The linkage apparatus of claim 6 wherein the upper linking means includes an upper linkage member and means for adjusting the length of said upper linkage member such that the angle of alignment of the use device with respect to a vertical line perpendicular to the plane of the vehicle may be adjusted by adjusting the length of the upper linkage member.

9. The linkage apparatus of claim 6 wherein said four point linkage mechanism includes a longitudinal vertical plane, wherein said fifth connecting means includes first means for attaching said upper linking means to the use device, and wherein said second connecting means includes second means for attaching said second arm member to the use device, said first and second attaching means including means for adjusting the angle of the use device with respect to the longitudinal vertical plane.

10. The linkage apparatus of claim 6 wherein said fourth connecting means includes third means for attaching said upper linking means to the vehicle, and wherein said first connecting means includes fourth means for attaching said first arm member to the vehicle; said attaching means including means for swinging the first arm member and the upper linking means from side to side with respect the vehicle.

11. A plow apparatus, comprising:

(a) a ground-engaging vehicle;

(b) means for creating a continuous trench in a ground subsurface when pulled by the vehicle, said trench creating means including a plow-blade;

(c) means for vibrating said plow-blade;

(d) linkage means for coupling the trench creating means to the vehicle, said linkage means including:

(i) a support member;

(ii) means for attaching said support member to the vehicle;

(iii) upper means for linking to said support member, said upper linking means having first and second ends, said first end being pivotally attached to said support member;

(iv) lower means for linking to said sup port member, said lower linking means having first and second ends and means for varying straight line length between said first and second ends, the first end of said lower linking means being pivotally attached to said support member; and (v) outer means for linking the second ends of the upper linking means and the lower linking means to the trench creating means, the second ends of the upper linking means and the lower linking means being pivotally connected to said outer linking means; and (e) means for pivoting said upper and lower linking means with respect to said vehicle about a substantially horizontal axis.

12. The plow apparatus of claim 11 wherein said lower linking means includes first and second arm members, and means for dampening vibrations between the first and second arm members, wherein said varying means includes means for pivotally connecting the first and second arm members, and wherein the first and second arm members have first and second ends, the first end of the first arm member being the first end of the lower linking means and the second end of the second arm member being the second end of the lower linking means.

13. The plow apparatus of claim 11 including means for swinging said linkage means from side to side with respect to the vehicle.

14. The plow apparatus of claim 11 including means for adjusting the angle of the plow-blade with respect to the linkage means.

15. The plow apparatus of claim 12 wherein the dampening means includes resilient members located on opposite sides of said pivotal connecting means such that the resilient members are interposed between portions of the first and second arm members.

16. The plow apparatus of claim 15, wherein the resilient members are air cushion bags.

17. The plow apparatus of claim 12 wherein said trench creating means includes a plow-blade housing having means for receiving said upper end of said plow-blade, said housing being pivotally attached to said outer linking means.

18. The plow apparatus of claim 17 wherein said plow-blade has an opening, wherein said trench creating means includes a pin which passes through said opening in the plow-blade, and means for connecting said pin to said plow-blade housing, said receiving means includes a box receiving the upper end of the plow-blade, said receiving means also including rubber strips and metal plates, the box containing said rubber strips and said metal plates packed around the plow-blade such that the movement of the upper end of the plow-blade is restricted to movement within said box.

19. The plow apparatus of claim 12 wherein the upper linking means includes means for maintaining the plow-blade at a desired angular orientation with respect to the surface of the ground as the vehicle traverses irregular terrain.

20. The plow apparatus of claim 19 wherein the maintaining means includes means for adjusting the length of said upper linking means such that the angle of alignment of the plow-blade with respect to the upper linking means may be adjusted.

21. The plow apparatus of claim 11 wherein said plow-blade has a front edge, two vertically extending side surfaces, and a tooth, the tooth extending downwardly and outwardly from the front edge and outwardly from the side surfaces of the plow-blade.

22. The plow apparatus for claim 21 wherein the tooth has an upper surface, the upper surface being aligned with respect to the front edge of the plow-blade such that the angle of the upper surface with respect to a line which is perpendicular to the front edge of the plow-blade is between 37 degrees and 43 degrees.

23. The plow apparatus of claim 12, wherein said support member extends above said upper linking means and provides support for said pivoting means, said pivoting means including a hydraulic cylinder, said hydraulic cylinder being pivotally connected to said support member and to said first arm member of said lower linking means.

24. A vibrating cable plow apparatus for attachment to a ground-engaging vehicle and cooperation with means for guiding a continuous cable, wherein the cable guiding means cooperates with the plow apparatus to lay a continuous cable in a subsurface opening, the plow apparatus comprising:

(a) means for creating a continuous trench in a ground subsurface, said trench creating means including an upright plow-blade having upper and lower ends;

(b) means for vibrating said plow-blade; and (c) linkage means for coupling the trench creating means to the vehicle, said linkage means including;

(i) a support member attaching to the vehicle;

(ii) upper means for linking to said support member, said upper linking means including first and second ends, said first end being pivotally attached to said support member, said upper linking means including means for adjusting the length of said upper linking means;

(iii) lower means for linking to said support member, said lower linking means including first and second arm members, said first and second arm members having first and second ends, the first end of the first arm member being pivotally attached to said support member, and the second end of the second arm member being pivotally attached to said trench creating means, said lower linking means further including means for pivotally connecting the first and second arm members and means for dampening vibrations between the first and second arm members, said dampening means including resilient members located on opposite sides of said pivotal connecting means and being interposed between elements of said first and second arm members, said pivotal connecting means having a substantially horizontal axis about which said first and second arms pivot; and (iv) outer means for linking the second ends of the upper linking means and the second arm member of the lower linking means to said trench creating means.

25. The cable plow apparatus of claim 24 wherein the first arm member includes at least two parallel first support members and at least two plate members extending therebetween, said dampening means further including means for attaching said resilient members to said plate members, said plates being integrally connected to said parallel support members; and wherein the second arm member includes at least two second support members and a second arm body member extending therebetween, said dampening means including means for attaching said resilient members to said body member, said body member being integrally connected to said second support members, said resilient members being interposed between said second arm body member and said plate members.

26. The cable plow apparatus of claim 24 including means for pivoting said linkage means about said first ends of said upper linking means and said first arm; means for pivoting the plow-blade on a vertical axis with respect to the linkage means; and means for pivoting said linkage means on a vertical axis with respect to the vehicle.

* * * * *